US005570860A

United States Patent [19]

Schoenherr

[11] Patent Number: 5,570,860

[45] Date of Patent: Nov. 5, 1996

[54] GUTTER BRACKET

[75] Inventor: Curtis A. Schoenherr, Madison Heights, Mich.

[73] Assignee: James R. Jay, Jr., St. Clair Shores, Mich.

[21] Appl. No.: 200,621

[22] Filed: Feb. 23, 1994

[51] Int. Cl.[6] ..... E04D 13/072

[52] U.S. Cl. ..... 248/48.2; 52/11

[58] Field of Search ..... 52/11, 12, 13, 52/14, 15; 248/48.1, 48.2, 206.1, 247, 249, 250

[56] References Cited

U.S. PATENT DOCUMENTS

| | | | |
|---|---|---|---|
| 317,841 | 5/1885 | Newton . | |
| 449,134 | 3/1891 | Porter | 248/249 |
| 560,884 | 5/1896 | Anderson et al. | 248/249 |
| 667,821 | 2/1901 | Fingles . | |
| 1,105,748 | 8/1914 | Braswell . | |
| 1,401,703 | 12/1921 | Hyre . | |
| 2,647,476 | 8/1953 | Gibbons . | |
| 2,739,775 | 3/1956 | Bertram . | |
| 3,864,882 | 2/1975 | Lasscock . | |
| 5,004,191 | 4/1991 | Corry | 248/48.2 |

FOREIGN PATENT DOCUMENTS

| | | | |
|---|---|---|---|
| 743841 | 1/1956 | United Kingdom | 248/250 |
| 939044 | 10/1963 | United Kingdom | 248/250 |

OTHER PUBLICATIONS

Product Catalog of Lynch Aluminum MFG Co, Peoria Il, p. 5, dated to best of knowledge 1991.

*Primary Examiner*—Michael Safavi
*Attorney, Agent, or Firm*—Peter D. Keefe

[57] ABSTRACT

A gutter hanger composed of a bracket portion and an elbow portion. The bracket portion has a main body, a clip connected to a first end of the main body and a nose connected to a second end of the main body. The elbow portion has a resiliently flexible arch which is connected to the first end of the main body and terminates in a right angle flange; and has a relatively inflexible knee brace which is connected to the second end of the main body and is connected to a tangent of the arch. The right angle flange and the arch collectively form a corner which is dimensioned to abut the inside corner of the gutter where the rear wall meets the bottom wall. When installed on a gutter, the gutter hanger according to the present invention provides a secure fit with a gutter at the rear wall and the U-shaped member thereof, as would be the case with a conventional gutter bracket, but further adds bracing support via the elbow portion which fully stabilizes the gutter from wind induced wobbling.

5 Claims, 1 Drawing Sheet

GUTTER BRACKET

BACKGROUND OF THE INVENTION

1. Field of the Invention

The present invention relates to the various methodologies used in the building trades to attach gutters to eaves of buildings, and more particularly to a gutter bracket which provides a stable secure attachment of the gutter to the eaves.

2. Description of the Prior Art

It is well known that safe and effective control of roof run-off must be carefully planned for during the construction of a building. Ordinarily in this regard, gutters are provided at the eaves of the building to capture water flowing down the roof and direct it in a controlled manner to a preselected outflow location. Modern day gutters may be of aluminum, galvanized steel or plastic construction, and are generally of a cross-section characterized by a flat rear wall, a flat bottom, and a convexly curved (as seen from the exterior) front wall which terminates at its upper end with a U-shaped member. One or more downspouts are provided which interface with the gutter to channel water to the ground at one or more preselected locations.

There are several ways of attaching the gutter to the eaves of a building. Commonly, gutter spikes are used to nail the gutter to a building structure behind the rear wall of the gutter. The gutter spike pierces the U-shaped member, passes through a ferrule, pierces the rear wall, and then penetrates into the building structure, usually a solid wooden board. Another approach is to utilize a conventional gutter bracket to hold the gutter to the eaves. A conventional gutter bracket has a main body which is sized to span the distance between the rear wall and the U-shaped member of the gutter. At one end of the main body is located a clip which slips over the rear wall of the gutter, and the other end of the main body is provided with a nose which is dimensioned to snugly seat into the U-shaped member. The clip is provided with an aperture. A spiral gutter bracket nail is used to hold the gutter to the eaves, whereby the nail is driven through the rear wall of the gutter at the clip aperture and into the building structure.

While these two methods of installing gutters are quite common, each has one or more disadvantages. In the case of the gutter spike method, the spike head is visible from the outside and the support derived from the spike alone may not be sufficient. The gutter bracket is hidden from view and does afford better support, but the gutter bracket may slip out of alignment with the gutter as its being nailed and gutter may be able to wobble on the gutter nail during high wind because a very long lever arm extends between the rear wall and the U-shaped member of the gutter.

Accordingly, what is needed in the art is a gutter hanger which provides all the advantages of a conventional gutter hanger and further provides assurance of alignment during nailing and improved support to prevent gutter wobbling in high wind.

SUMMARY OF THE INVENTION

The present invention is a gutter hanger which provides all the advantages of a conventional gutter hanger and further provides improved support to prevent gutter wobbling in high wind.

The gutter hanger according to the present invention is composed of a bracket portion and an elbow portion. The bracket portion has a main body, a clip connected to a first end of the main body and a nose connected to a second end of the main body. The elbow portion has a resiliently flexible arch which is connected to the first end of the main body and terminates in a right angle flange; and further has an inflexible knee brace which is connected to the second end of the main body and also is connected to a tangent of the arch. The right angle flange and the arch collectively form an elbow corner which is dimensioned to abut the inside corner of the gutter where the rear wall thereof meets the bottom wall thereof.

When installed on a gutter, the gutter hanger according to the present invention provides a secure fit with a gutter at the rear wail and the U-shaped member thereof, as would be the case with a conventional gutter bracket, but further assures that alignment of the gutter bracket will be maintained during nailing and further adds bracing support via the elbow portion which fully stabilizes the gutter from wind induced wobbling.

Accordingly, it is an object of the present invention to provide a gutter bracket which imparts improved stability to a gutter hung therewith.

It is an additional object of the present invention to provide a gutter hanger which includes an elbow portion which serves to provide assured alignment during nailing and further provide a brace between the inside corner of a gutter and the U-shaped member thereof to thereby provide stability to the gutter.

It is a further object of the present invention to provide a gutter hanger which includes an elbow portion which serves to provide a brace between the inside corner of a gutter with the U-shaped member thereof to thereby provide stability to the gutter, wherein the elbow is composed of a flexible curved portion and an inflexible linear portion which is form fitable to the shape and dimension of the gutter.

These, and additional objects, advantages, features and benefits of the present invention will become apparent from the following specification.

DETAILED DESCRIPTION OF THE PREFERRED EMBODIMENT

Figure 1:
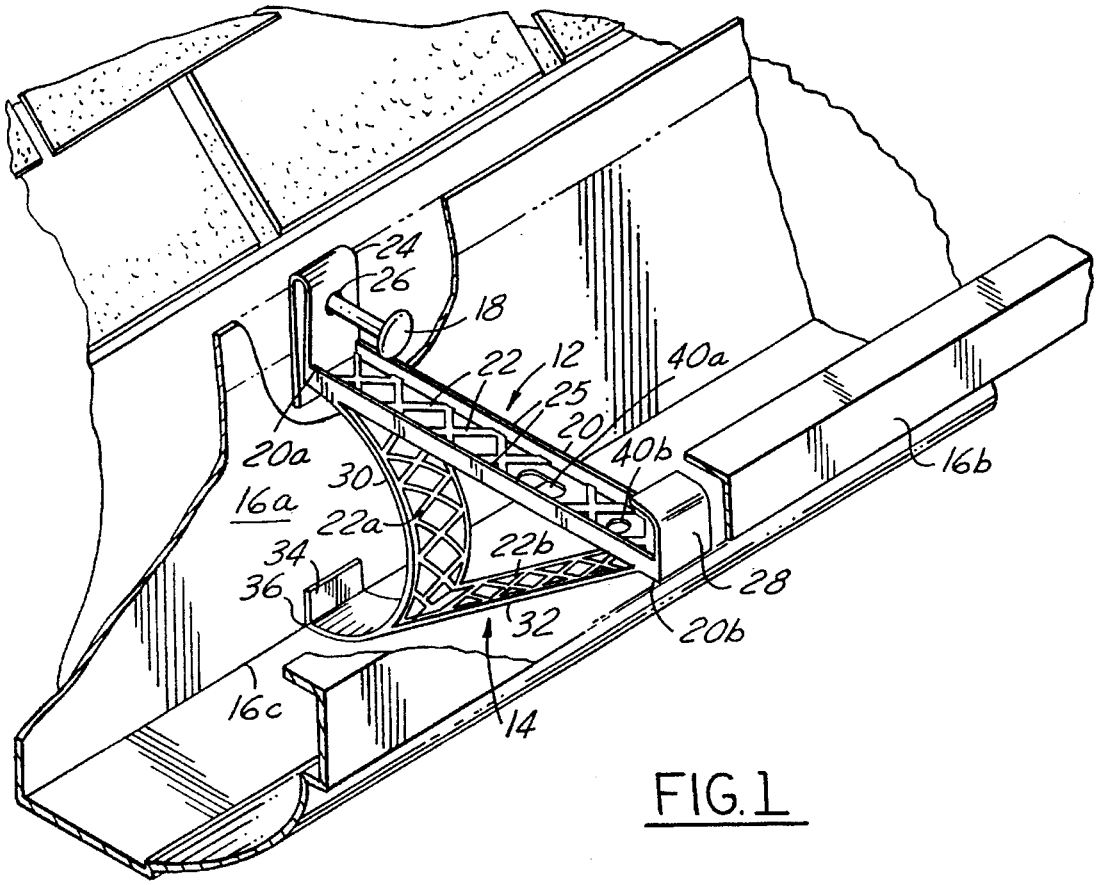
FIG. 1 is a partly sectional, partly broken away perspective view of the gutter bracket according to the present invention, shown being installed with respect to a gutter.
Figure 2:
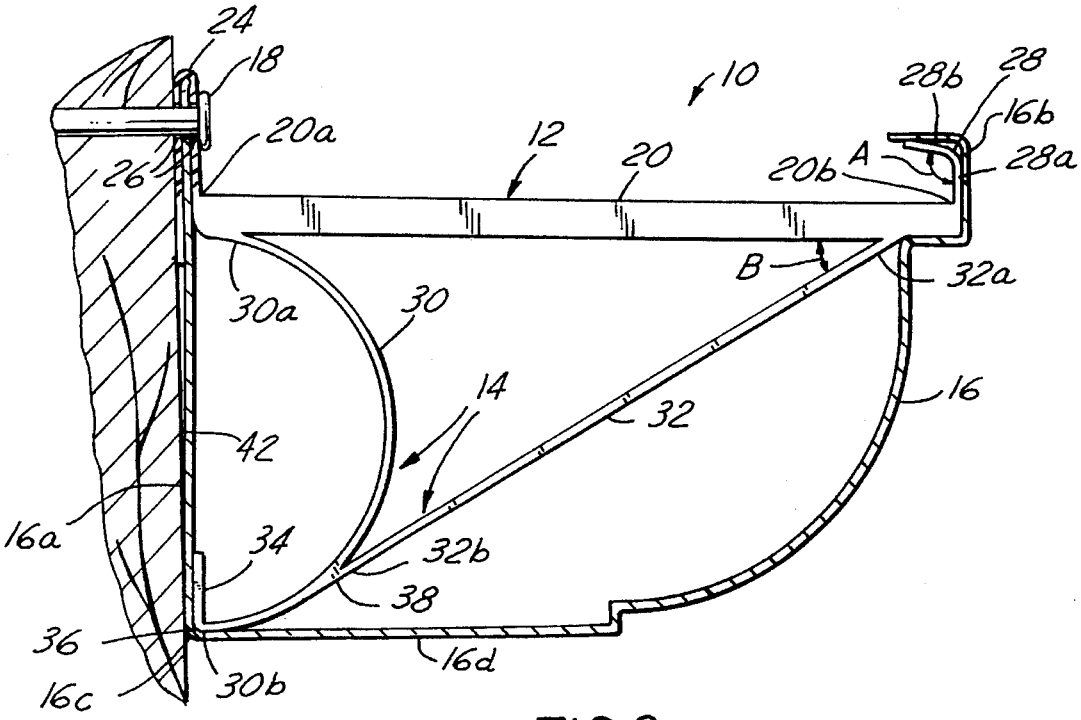
FIG. 2 is a partly sectional side view of the gutter bracket according to the present invention, shown installed with respect to a gutter.

Referring now to FIGS. 1 and 2, the structure and function of the gutter bracket 10 according to the present invention will be elucidated using the preferred example depicted therein.

The gutter bracket 10 is preferably constructed of a high impact resistant plastic material such as polypropylene, polyethylene, or either of these with a quantity of fiberglass added thereto. Other suitable materials could also be used, such as aluminum. The gutter bracket 10 is composed of a bracket portion 12 and an elbow portion 14. As can be discerned from FIGS. 1 and 2, the bracket portion 12 serves to engage a gutter 16 in a manner similar to that of a conventional gutter bracket. However, it will also be noted that the elbow portion 14 adds an extra dimension of bracing to the gutter 16 which serves to prevent the gutter from wobbling about the gutter nail 18, as will become clearer from the description hereinbelow.

The bracket portion 12 has a main body 20 which is rigidly linear and preferably provided with ribbing 22 and sidewalls 25 for purposes of providing strength with minimal material. Integrally connected to a first end 20*a* of the main body 20 is a clip 24. The clip 24 is oriented generally at a right angle to the main body 20 and is structured and oriented to receive therein the rear wall 16*a* of the gutter 16. The clip 24 is provided with an aperture 26 for receiving therethrough the gutter nail 18. Integrally connected to a second end 20*b* of the main body 20 is a nose 28. The nose is dimensioned to seat snugly into the U-shaped member 16*b* of the gutter 16. This is accomplished by an upright 28*a* oriented at ninety degrees to the main body and a lip 28*b* oriented at an angle A of about 97 degrees to the upright. Over-all, the bracket portion 12 is structured and dimensioned so that when the nose 28 is seated in the U-shaped member 16*b* of the gutter 16, then the clip 24 simultaneously receives thereinto the rear wall 16*a* of the gutter, wherein the main body 20 is substantially parallel with respect to the bottom wall 16*d*.

The elbow portion 14 is composed of a resiliently flexible arch 30 and an inflexible knee brace 32. A first end 30*a* of the arch 30 is connected with the first end 20*a* of the main body 20. A second end 30*b* of the arch 30 is integrally connected with a right angle flange 34. The right angle flange 34 and the second end 30*b* of the arch 30 form an elbow corner 36 which is structured to abut the inside corner 16*c* formed by the joinder of the rear wall 16*a* and the bottom wall 16*d* of the gutter 16. A first end 32*a* of the knee brace 32 is connected with the second end 20*b* of the main body 20. A second end 32*b* of the knee brace 32 connects with the arch 30 at a tangent 38 thereto. Preferably, both the arch 30 and the knee brace 32 are provided with ribbing 22*a*, 22*b*, respectively, for the purpose of structural strength with minimal material.

As can be discerned from FIGS. 1 and 2, the elbow portion 14 is structured and dimensioned so that when the nose 28 is seated in the U-shaped member 16*b* of the gutter 16 and the clip 24 receives thereinto the rear wall 16*a* of the gutter in the manner aforementioned, then the elbow corner 36 abuts the gutter corner 16*c*. Preferably, the angle B of the knee brace 32 with respect to the main body is about thirty-one degrees.

An example of a gutter bracket 10 which is structured and dimensioned to fit a standard gutter 16, is as follows. The structural material is a polypropylene or a polyehtylene with a quantity of fiberglass for strength. The length of the main body 20 is about five inches. The length of the arch 30 is about two and one-half inches. The length of the knee brace 32 is about four and one-quarter inches, the width of the main body 20, clip 24, nose 28, arch 30 and knee brace 32 is about sixty-four hundredths of an inch, and the thickness of these components is about 5 hundredths of an inch. The angle B of the knee brace 32 with respect to the main body 20 is about thirty-one degrees. The nose 28 has a height of about sixty-two hundredths of an inch and the lip 28*b* has a length of about four-tenths of an inch. The lip 28*b* has an angle A with respect to the upright 28*a* of about 97 degrees. Finally, the clip 24 has a length of about one inch.

In operation, the user would place the nose into the U-shaped member of the gutter and slip the rear wall of the gutter into the clip. The resiliency of the arch is such that when the main body is parallel with the bottom wall of the gutter, the elbow corner is firmly placed into the inside corner of the gutter. Now a gutter nail is used to pierce the rear wall at the aperture in the clip to cause the gutter to be affixed to a building structure. In this regard, it is desired for the arch to be resiliently flexible so that the elbow corner is pressed into the inside corner of the gutter.

As can be discerned from a comparison of the shape of the clip 24 as depicted in FIGS. 1 and 2, after the nail 18 is driven home the clip collapses into a narrow profile wherein the rear wall 16*a* of the gutter 16 is brought into close, substantially parallel, proximity to the building facia board 42.

Because of the knee brace and its affixment between the inside corner of the gutter and the U-shaped member by operation of the arch, the gutter is prevented, due to the bracing thereby provided, from slipping out of alignment with the gutter, particularly at the U-shaped member, and further from wobbling at the gutter nail even high wind and high water load conditions.

As will be noted in FIGS. 1 and 2, holes 40*a*, 40*b* may be provided in the main body for purposes of connecting thereto a conventional roof hook strap (not shown) in a manner well known in the art.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A gutter bracket for connecting a gutter to a structure, the gutter having a rear wall, a bottom wall and a front wall, the front wall having a U-shaped member, the rear wall and the bottom wall joining to form an inside corner of the gutter, said gutter bracket comprising:

a bracket portion, comprising:

a main body having a first end and a second end, said main body being elongated and substantially straight, said main body having a first side and an opposite second side, a first axis extending from said first end to said second end of said main body, a second axis being perpendicular to said first axis;

clip means connected with said first end of said main body for receiving in a direction substantially parallel to said second axis the rear wall of a gutter therewithin; and nose means having an upright extending from first side of said main body at an orientation substantially parallel to said second axis for seating within the U-shaped member of the gutter; and an elbow portion comprising:

an arch having a first end and a second end, said first end of said arch being connected to said second side of said main body at substantially said first end thereof, said arch having a concave shape facing away from said first end of said main body, said first and second ends of said arch being mutually displaced along a line substantially parallel with respect to said second axis; and a knee brace having a first end and a second end, said knee brace being elongated and substantially straight, said first end of said knee brace being connected to said second side of said main body at substantially said second end thereof, said knee brace being oriented at an acute angle with respect to said first axis, said second end of said knee brace being connected to said arch at a tangential intersection thereto substantially adjacent said second end thereof;

wherein said second end of said arch is abuttingly disposed at the inside corner of the gutter when said nose has been seated in the U-shaped member of the gutter and said clip has received the rear wall of the gutter.

2. The gutter bracket of claim 1, wherein said arch is resiliently flexible and said knee brace is substantially inflexible.

3. The gutter brace of claim 2, further comprising a flange connected to said second end of said arch, said flange being oriented substantially parallel with respect to said second axis.

4. The gutter bracket of claim 1, wherein said gutter bracket is constructed of at least one of plastic and fiber glass material.

5. The gutter bracket of claim 4, wherein said gutter bracket is constructed of a combination of plastic and fiber glass material.

* * * * *